US007100811B2

(12) United States Patent
Pettersson et al.

(10) Patent No.: US 7,100,811 B2
(45) Date of Patent: Sep. 5, 2006

(54) WEB GUIDE AND METHOD

(75) Inventors: Niklas Pettersson, Enkoping (SE); Hanko Kiessner, Salt Lake City, UT (US)

(73) Assignee: Emsize AB, Enkoping (SE)

( * ) Notice: Subject to any disclaimer, the term of this patent is extended or adjusted under 35 U.S.C. 154(b) by 16 days.

(21) Appl. No.: 10/712,029

(22) Filed: Nov. 14, 2003

(65) Prior Publication Data

US 2005/0103923 A1 May 19, 2005

(51) Int. Cl.
*B65H 20/24* (2006.01)
*B65H 9/00* (2006.01)

(52) U.S. Cl. ..... 226/110; 226/168; 271/238; 493/59

(58) Field of Classification Search ..... 226/110, 226/168, 193, 196.1; 242/615.3; 271/238, 271/248, 253; 493/59, 71, 147
See application file for complete search history.

(56) References Cited

U.S. PATENT DOCUMENTS

| | | | | |
|---|---|---|---|---|
| 2,991,679 | A * | 7/1961 | Moran | 83/443 |
| 3,667,751 | A * | 6/1972 | Zernov et al. | 271/248 |
| 3,743,154 | A | 7/1973 | Brewitz | |
| 4,044,641 | A | 8/1977 | Burt, Jr. et al. | |
| 4,194,662 | A | 3/1980 | Coburn | |
| 4,252,233 | A * | 2/1981 | Joice | 198/692 |
| 4,364,504 | A * | 12/1982 | Meyers | 226/76 |
| 4,657,239 | A * | 4/1987 | Ikesue et al. | 271/227 |
| 5,098,081 | A * | 3/1992 | DeFigueiredo | 271/240 |
| 5,209,467 | A * | 5/1993 | Schmaling | 271/240 |
| 5,251,889 | A * | 10/1993 | Spencer et al. | 271/171 |
| 5,411,252 | A * | 5/1995 | Lowell | 271/240 |
| 5,511,713 | A * | 4/1996 | Sakaguchi et al. | 242/615.3 |
| 6,840,898 | B1 * | 1/2005 | Pettersson | 493/473 |
| 2002/0017754 | A1 * | 2/2002 | Kang | 271/223 |

FOREIGN PATENT DOCUMENTS

| | | |
|---|---|---|
| GB | 1 546 789 | 5/1979 |
| GB | 2 023 104 | 12/1979 |
| GB | 2 164 026 | 3/1986 |

* cited by examiner

*Primary Examiner*—Kathy Matecki
*Assistant Examiner*—Evan Langdon
(74) *Attorney, Agent, or Firm*—Young & Thompson

(57) ABSTRACT

The present invention relates to a method of production and an arrangement for feeding and guiding web materials in laterally separate paths from a web supply to a machine for producing packing blanks. More specifically a web guide is disclosed, capable of controlling web materials in laterally separate paths from a side by side storage to be advanced in parallel paths through the machine and to be separately or simultaneously processed into packing blanks.

7 Claims, 2 Drawing Sheets

WEB GUIDE AND METHOD

TECHNICAL FIELD OF INVENTION

The present invention relates to a method of production and arrangement for feeding and guiding web materials in laterally separate paths to a machine for producing packing blanks.

BACKGROUND AND PRIOR ART

As used herein, "web material" refers to a material that is thin in relation to its width and having a continuous length. In this connection, the web material is advanced to a machine for producing packing blanks. "Packing blanks" refers to a semi-finished container or similar packing product, that is afterwards modified to cover an item for transport or storage. Typical web materials for producing packing blanks include, e.g., corrugated cardboard of different grades and widths provided on reels, or folded to form an orthogonal package known as fan fold.

Machines for producing packing blanks are known in different configurations. The specific machines referred to herein are typically equipped with multiple cutting and creasing tools that are individually controllable within an operative width of the machine. I.e., the tools are individually positioned within the operative width, and individually operated to engage the web material for cutting and creasing operations. Such operations are notoriously performed in a feed direction through the machine and, if appropriate, also in a transverse direction.

The web materials are advanced through feeder means that are operated and controlled in synchronization with the operation and control of the machine and its processing tools. The feeder means may be operatively connected to the machine, typically though the feeding is an integrated function of the machine. An example of the machine type referred to is found in WO 00/21713.

The producers of packing blanks typically desire a machine having an operative width that is wider than the largest dimension presently processed, thereby ensuring a capacity to meet future needs. Another relevant factor in this context is the versatility of the machine to shift the production of different products, requiring webs of different widths and/or grades. Accordingly, the full width and capacity of the machine is rarely exploited in the production of packing blanks. Typically, a supply of webs having different widths or grades are lined up in the feed direction, requiring significant storage space and feeding distance upstream of the machine. This disadvantage is another problem in connection with prior methods and equipment.

SUMMARY OF THE INVENTION

An object of the present invention is therefore to provide a method of production that allows a higher exploitation of a machine for producing packing blanks.

This object is met, according to the invention, through feeding web materials individually in parallel feed paths through the machine, comprising the step of guiding the web materials in laterally separate paths from a side by side storage to the machine.

The method not only permits a faster shifting between web materials, but provides also for multiple processing or simultaneous production of packing blanks from multiple webs.

Another object of the present invention is to provide a method and a web guide ensuring that the webs are laterally separated as they are introduced in a machine for producing packing blanks.

Still another object is to increase the personal security at a production site.

These objects are met through the step and arrangements for controlling the longitudinal margins of each web in a guided passage that is laterally adjustable to accommodate the width of the web and to locate the position of each web relative to the machine.

Still another object is to provide a web guide adapted for guiding a fan fold web material from a web supply to a machine for producing packing blanks, while preserving the integrity of the web portion between the crease lines/fold lines, of the fan fold web.

This object is met by equipping the web guide with a line up means comprising a capstan, wherein a circumference of the capstan is defined through horizontal bars parallel with a rotation axis of the capstan, and the cord length between adjacent bars of the capstan corresponding to the distance between the fold lines of the fan fold web material.

Other objects met through the method and arrangements presented are, e.g., low cost and energy consumption, avoidance of complicated web shifter structures and a low consumption of construction materials. The capstan and web guide allows a transport that preserves the web material, reducing the feed resistance by applying a rotary feed, thereby reducing the pulling power and wear on the web material.

BRIEF DESCRIPTION OF THE DRAWINGS

The invention is more closely described below, reference being made to the accompanying drawings illustrating one embodiment of the invention. In the drawings.

DETAILED DESCRIPTION OF EMBODIMENTS

Figure 1:
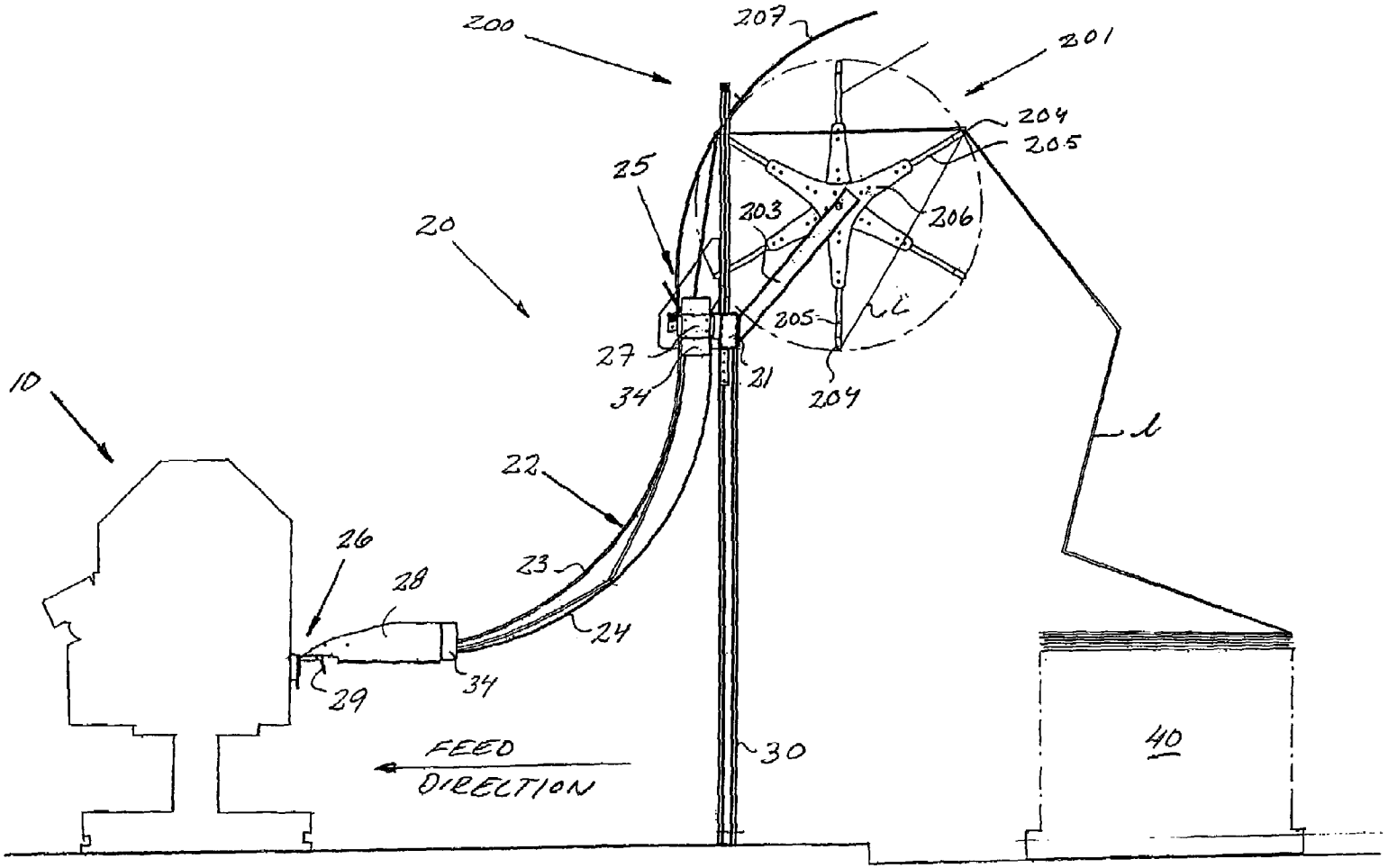
FIG. 1 is a side view showing a typical installation for practicing the method.
Figure 2:
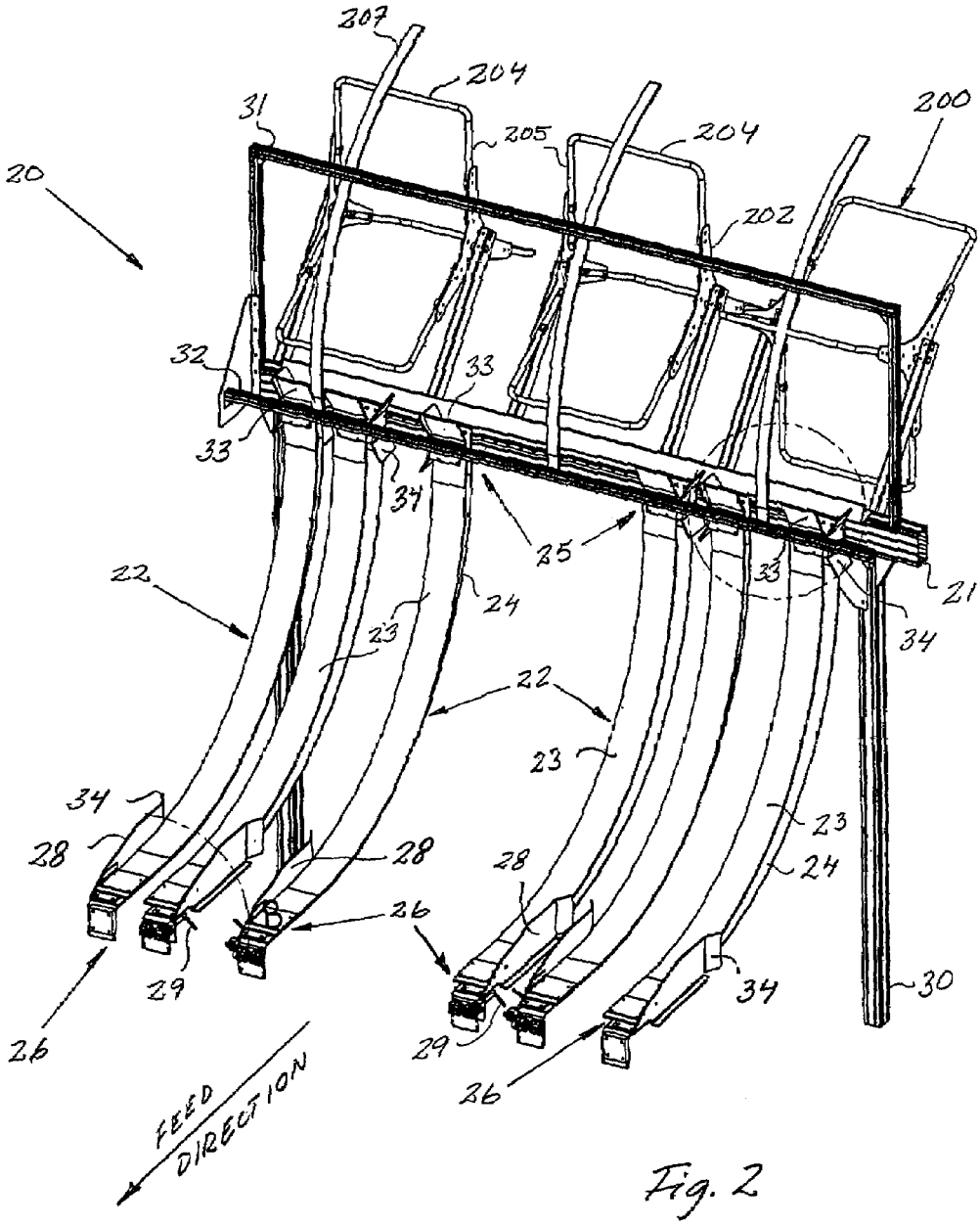
FIG. 2 is a perspective view showing the web guide.

In the following disclosure, reference is made to FIGS. 1 and 2. In FIG. 1, a machine for producing packing blanks is generally identified through reference number 10, a web guide is generally numbered 20, and a web supply in the form of a package of fan fold web material is generally numbered 40. In FIG. 2, the web guide 20 is shown separated from the machine 10 and web supply 40.

The machine 10 is typically equipped with multiple cutting and creasing tools that are individually controllable within the operative width of the machine. The tools are supported on guides and controlled by a programmable control unit for individual, lateral positioning on the guides. Tool displacement may be realized through an endless, rotating belt to which the tools are individually connected and disconnected. The tools are also individually controlled to engage the web material for cutting and creasing operations. Such operations are notoriously performed in a feed direction through the machine. In drawing 1, the feed direction goes from right to left. Typically, the machine 10 also comprises tools operative in a second direction transversely to the feed direction. A feed function is integrated in the machine 10, comprising feed rollers engaging the web and operative to advance the web through the machine to be processed into packing blanks by the cutting and creasing tools.

The detailed structure and operation of the machine 10 is not critical in order to profit from the invention. However, a significant feature of the machine 10 employed in this invention is that the feed function is divided into individually operating sections over the operative width of the machine.

A sectioned feed function may be realized in many ways, such as through separate feed rollers, each feed roller driven separately from the others. One solution foresees an integral, driven feed roller cooperating with multiple rolls or wheels, the rolls or wheels controlled individually or in sets to engage the web and to provide a counter pressure from an opposite side of the web. Another alternative or complementary realization of a sectioned feed function comprises the step of frictionally arresting a web while the feed rollers are running. To this end, a clamping force may be applied regionally through a number of brake means distributed over the operative width of the machine. Such brake means may be hydraulically, pneumatically or electrically driven and controlled individually or in sets to press a web against structural elements of the machine frame, e.g.

The web guide 20 is effective for controlling the web materials to be advanced in laterally separate paths to the machine 10 for producing packing blanks. The web guide 20 comprises a frame having a horizontal member 21 extending transversely to the feed direction of the webs. Each web is controlled by a pair of guide rails 22, the guide rails running in parallel in the feed direction and being laterally displaceable on the horizontal member 21 to accommodate the width and longitudinal margins of a web material. Each guide rail 22 comprises an upper flexible strip 23 spaced from a lower flexible strip 24, defining there between a guided passage for the longitudinal margin of the web. The guided passage runs continuously from an entrance end 25 to an exit end 26 of the guide rail 22. The upper and lower flexible strips are made of any suitable material such as thin metal or synthetic materials, e.g. The spacing that provides the guided passage is ensured through a U-shaped clamp 27 separating the strips at the entrance end 25, and through a vertical shield 28 that holds the upper and lower strips in a spaced relation at the exit end 26. Within each pair of guide rails 22 the vertical shields 28 are facing each other from the opposite longitudinal margins of the two guide rails, preventing the web from leaving the guided passages when the pair of guide rails 22 is laterally adjusted to accommodate the width of the web material.

From the above it will be appreciated that the guide rails 22, covering opposite sides of the longitudinal margins of the webs in motion, provides increased personal security at the production site.

The exit end 26 of guide rail 22 is connectable to the machine 10. Advantageously the exit end 26 is laterally displaceable on guide means, carried on the machine 10 as conventional. For example, the exit end 26 may be formed to slide on a horizontal rail arranged on the machine. A locking device 29 secures the exit end 26 to the machine in a lateral position. The locking ensures that the web maintains a correct location relative to the machine 10 in the transverse or lateral direction.

The guide rail 22 is laterally displaceable on the frame of web guide 20. To this end, the guide rail 22 may be formed to slide on a horizontal rail arranged on the horizontal member 21.

The guide rails 22 may be sliding freely on the frame of web guide 20 and on the machine 10, to be manually positioned in order to accommodate the width of a web material and to locate the web relative to the machine. Spacer flanges 34 at entrance ends and on shields 28 define a minimum lateral gap between adjacent webs.

Alternatively, the lateral adjustment of guide rails 22 may be achieved through a mechanical drive such as a geared or helical rack, rotatable on the machine or on the horizontal member of the frame, and engaging a geared seat on the guide rail 22. Alternative mechanical structures may be contemplated in a driven lateral displacement of the guide rails 22, such as chains or belts, e.g. A driven lateral displacement of the guide rails 22 may also rely on an endless member carried on the machine 10 and driven to rotate for displacement in alternate directions by employment of an upper and lower part of the endless member.

An advantageous embodiment foresees that the guide rails of at least one pair of guide rails are controlled in parallel for lateral displacement in mutually opposite directions relative to a center. This may be achieved in a driven displacement using the endless member, a chain, a belt, or by employment of a helical rack that is geared in opposite directions, e.g. Preferably, the center of parallel displacement is adjustable in lateral direction and applied at least to a central web path through the web guide 20 and through the machine 10 for producing packing blanks.

Further details apparent from the drawings, such as the vertical posts 30 and horizontal rack 31 of frame 20, front rail 32 of horizontal member 21, the flaring plates 33 at the entrance ends 25, and other details not mentioned, are less critical features of the illustrated embodiment and not further discussed herein.

Reference number 40 refers to a package in a supply of fan fold web material. Packages 40 are stored side by side transversely to the feed direction, substantially in parallel with the machine 10 and web guide 20. The number and total width of the packages 40 relates to the operational width of the machine 10. The packages 40 may comprise fan fold webs of different sizes and/or different grades. In exchange for packages 40 of fan fold web material, the machine 10 may also be supplied web materials stored on reels and controlled by the web guide of this invention.

In order to preserve the integrity of the web portion between the crease or fold lines of the fan fold web material, a line up means 200 is associated with the web guide 20. The line up means 200 is effective for aligning the fan fold web, in a vertical plane, with the main direction of guide rails 22 for a problem-free passage at the entrance ends 25.

Line up means 200 comprises a capstan 201, freely rotating about an axis 202 transversely to the feed direction. The axis 202 is supported on arms 203 extending from the frame 20. Advantageously, the arms 203 may be laterally displaceable on the horizontal member 21 of the frame to be positioned at a center of each web path, respectively.

The capstan 201 has a circumference, illustrated through a dash-dot circle line in FIG. 1, that is defined through horizontal bars 204 carried in the ends of radial members 205 extending from a central hub 206 of the capstan. A cord length c between successive bars 204 of the capstan 201 corresponds to a length 1 between fold lines of the fan fold material. When loading the fan fold web into the web guide 20, capstan 201 is synchronized to support the web through the bars 204 successively engaging the fold lines as the capstan rotates, thereby directing the web into the guide rails without causing additional folding of the straight web portion between the fold lines of the fan fold material. The capstan 201 is likewise effective for aligning a reeled web material with the guide rails 22.

Preferably, the angle between radial members 205, or angular distance between adjacent bars 204, is 120° as seen from the centre of capstan 201. Naturally, other angular distances may be chosen as long as the relation between cord length c and fold line distance 1 is met. However, three bars 204 forming an isosceles triangle reduces the risk of bad synchronization and provides the most compact structure for this purpose.

Further, the capstan 201 may be assisted by an arm 207 that is effective for holding-down the web towards the capstan. The arm 207 preferably is flexible, made of thin metal or synthetic material, e.g., and attached to the frame 20 so as to reach upstream from the location of the entrance ends of guide rails 22. The arm 207 may be biased, through a spring element or through an inherent bias, to press the web for contact with the bars 204 of the capstan as the capstan rotates, anti-clockwise in FIG. 1.

The web guide 20 disclosed above makes possible a method of production that allows a higher exploitation of a machine for producing packing blanks. By guiding the web materials in laterally separate paths from a side by side storage to the machine, not only a faster shifting between web materials will be achieved. Combined with a sectioned feed function, capable of feeding individual webs in parallel paths through the machine for processing into packing blanks, the web guide also makes possible a multiple processing, i.e. a production of packing blanks from two or more webs at the same time. As a whole, the invention leads to shorter standstills at shifting operations, better exploitation of operative machine width, and higher flexibility in the production of different sized or configured packing blanks. Another important aspect of the invention is that the guide rails 22, denying access to the longitudinal margins of the webs in motion, provides increased personal security at the production site.

The invention claimed is:

1. A guide for controlling web material in laterally separate paths from a web supply to a machine for producing packing blanks, comprising:

a frame extending transversely to a feed direction of the web;

at least one pair of laterally separated guide rails running in parallel in said feed direction, each guide rail comprising an upper and a lower flexible strip, respectively, the strips defining a guided passage from an entrance end to an exit end of the guide rail;

the guide rails being laterally displaceable on the frame;

the exit end of each guide rail connectable to the machine for producing packing blanks, and each laterally separated path of web material being associated with a line up means, upstream of the guide rail entrance ends, for aligning the web material with the guided passage, wherein, the line up means comprises a capstan, supported on the frame and freely rotating about an axis extending transversely to the feed direction, and a circumference of the capstan is defined through horizontal bars parallel with the axis of rotation, and the cord length between adjacent bars of the capstan corresponding to the distance between the fold lines of a fan fold web material.

2. The arrangement of claim 1, wherein the upper and lower guide-rail strips are secured in horizontally separated relation at the entrance end through a clamp, and are fixedly spaced vertically at the exit end through a vertical shield, confining the web laterally in the passage.

3. The arrangement of claim 1, wherein at least two pairs of guide-rails are laterally positioned on the frame, each pair of guide-rails providing guided passage for webs being individually advanced side by side through the arrangement.

4. A guide for controlling web material in laterally separate paths from a web supply to a machine for producing packing blanks, comprising:

a frame extending transversely to a feed direction of the web;

at least one pair of laterally separated guide rails running in parallel in said feed direction, each guide rail comprising an upper and a lower flexible strip, respectively, the strips defining a guided passage from an entrance end to an exit end of the guide rail;

the guide rails being laterally displaceable on the frame;

the exit end of each guide rail connectable to the machine for producing packing blanks, and each laterally separated path of web material being associated with a line up means, upstream of the guide rail entrance ends, for aligning the web material with the guided passage, wherein the line up means further comprises a flexible arm, reaching upstream from the entrance end and biased to press the web material towards a capstan.

5. The arrangement of claim 4, wherein the capstan has an axis of rotation and a circumference defined through horizontal bars parallel with the axis of rotation, the cord length between adjacent bars of the capstan corresponding to a distance between folding lines of a fan fold material.

6. The arrangement of claim 5, wherein an angular distance between adjacent bars of the capstan is 120°, the cord lengths defining an isosceles triangle.

7. The arrangement of claim 5, wherein the capstan further comprises a flexible arm, reaching upstream from the guide-rail entrance end and biased to press the fan fold material towards the capstan.

* * * * *